US007829488B2

(12) United States Patent
Bennett

(10) Patent No.: US 7,829,488 B2
(45) Date of Patent: Nov. 9, 2010

(54) NON-WOVEN GLASS FIBER MAT FACED GYPSUM BOARD AND PROCESS OF MANUFACTURE

(75) Inventor: Glenda Beth Bennett, Toledo, OH (US)

(73) Assignee: Johns Manville, Denver, CO (US)

( * ) Notice: Subject to any disclaimer, the term of this patent is extended or adjusted under 35 U.S.C. 154(b) by 233 days.

(21) Appl. No.: 12/017,450

(22) Filed: Jan. 22, 2008

(65) Prior Publication Data

US 2009/0186549 A1 Jul. 23, 2009

(51) Int. Cl.
*B32B 13/02* (2006.01)

(52) U.S. Cl. ..... 442/386; 428/294.7

(58) Field of Classification Search ..... 442/386
See application file for complete search history.

(56) References Cited

U.S. PATENT DOCUMENTS 6,852,656 B1 * 2/2005 La Greca et al. ..... 501/35
2004/0266304 A1 * 12/2004 Jaffee ..... 442/386
2007/0039300 A1 * 2/2007 Kahlbaugh et al. ..... 55/527
2008/0014813 A1 * 1/2008 Xing et al. ..... 442/59

* cited by examiner

*Primary Examiner*—Lynda Salvatore
(74) *Attorney, Agent, or Firm*—Robert D. Touslee

(57) ABSTRACT

A gypsum board comprises a set gypsum layer having a first face and a second face. An uncoated fibrous mat is affixed to at least one of the faces. The mat comprises a non-woven web bonded together with a resinous binder. The web comprises glass fiber consisting essentially of a major portion composed of chopped continuous glass fibers having an average fiber diameter ranging from about 8 to 25 μm and optionally a minor portion consisting essentially of at least one of small diameter glass fibers having a fiber diameter of at most about 13 μm and microfibers having an average fiber diameter ranging from about 0.05 to about 6.5 μm. The board is exceedingly durable and has a high resistance to water absorption, rendering it particularly useful for exterior insulation systems.

36 Claims, 1 Drawing Sheet

NON-WOVEN GLASS FIBER MAT FACED GYPSUM BOARD AND PROCESS OF MANUFACTURE

BACKGROUND OF THE INVENTION

1. Field of the Invention

The present invention relates to a gypsum board used in building construction and to a process for its manufacture; and more particularly, to a non-woven glass fiber mat comprising a blend of glass fibers having different diameters and lengths bonded together with a resinous latex binder, a gypsum board or similar cementitious product in panel form faced on at least one side with such a mat, and processes for the manufacture thereof.

2. Description of the Prior Art

Construction boards formed of a gypsum core sandwiched between facing layers are used in the construction of virtually every modern building. Various forms of such construction boards, generally known as gypsum boards, are employed as a surface for walls and ceilings and the like, both interior and exterior. Other forms are used in exterior finishing and insulation systems, interior lath systems, and roofing systems. All of these forms are relatively easy and inexpensive to install, finish, and maintain In suitable forms, they are relatively fire resistant.

Although paper-faced gypsum wallboard is most commonly used for finishing interior walls and ceilings, other forms with different kinds of facings have superior properties that are essential for other uses. One known facing material is non-woven fiberglass mat.

Gypsum wallboard and gypsum panels are traditionally manufactured by a continuous process. A gypsum slurry is first generated in a mechanical mixer (sometimes called a pin mixer) by mixing at least one of anhydrous calcium sulfate ($CaSO_4$) and calcium sulfate hemihydrate ($CaSO_4.\frac{1}{2}H_2O$, also known as calcined gypsum), water, and other substances, which may include set accelerants, waterproofing agents, mineral, glass, or other synthetic reinforcing fibers, and the like. The gypsum slurry is normally deposited on a continuously advancing, lower facing sheet, such as kraft paper or a non-woven fibrous mat. Various additives, e.g. cellulose and glass fibers, are often added to the slurry to strengthen the gypsum core once it is dry or set. Starch is frequently added to the slurry in order to improve the adhesion between the gypsum core and the facing. Foam may be added to reduce the density of the slurry and the resulting set gypsum core. A continuously advancing upper facing sheet is laid over the gypsum and the edges of the upper and lower facing sheets are pasted to each other with a suitable adhesive. The facing sheets and gypsum slurry are passed between parallel upper and lower forming plates or rolls in order to generate an integrated and continuous flat strip of unset gypsum sandwiched between the sheets. Such a flat strip of unset gypsum is known as a facing or liner. The strip is conveyed over a series of continuous moving belts and rollers for a period of several minutes, during which time the core begins to hydrate back to gypsum ($CaSO_4.2H_2O$). The process is conventionally termed "setting," since the rehydrated gypsum is relatively hard. During each transfer between belts and/or rolls, the strip is stressed in a way that can cause the facing to delaminate from the gypsum core if its adhesion is not sufficient. Once the gypsum core has set sufficiently, the continuous strip is cut into shorter lengths or even individual boards or panels of prescribed length. The set core is generally termed a gypsum core, notwithstanding the presence of other constituents and reinforcements, such as those delineated above. Preferably, the set core comprises at least 85% by weight of hydrated gypsum.

After the cutting step, the gypsum boards are fed into drying ovens or kilns so as to evaporate excess water. Inside the drying ovens, the boards are blown with hot drying air. After the dried gypsum boards are removed from the ovens, the ends of the boards are trimmed off and the boards are cut to desired sizes. The boards are commonly sold to the building industry in the form of sheets nominally 4 feet wide and 8 to 12 feet or more long and in thicknesses from nominally about ¼ to 1 inches, the width and length dimensions defining the two large faces of the board.

While paper is widely used as a facing material for gypsum board products because of its low cost, many applications demand water resistance that paper facing cannot provide. Upon exposure to water either directly in liquid form or indirectly through exposure to high humidity, paper is highly prone to degradation, such as by delamination, that substantially compromises its mechanical strength. Gypsum products typically rely on the integrity of the facing as a major contributor to their structural strength. Consequently, paper-faced products are generally not suited for use in either exterior applications or for interior locations in which exposure to high moisture or humidity is presumed. Alternative products have employed water resistant additives to the gypsum core itself or use of non-paper facers on which a further water resistant coating is added. These expedients are not always sufficient to provide the needed properties, and they often entail higher weight and complicated and costly additional manufacturing steps.

In addition, there is growing attention being given to the issue of mold and mildew growth in building interiors and the potential adverse health impact such activity might have on building occupants. The paper facing of conventional gypsum board contains wood pulp and other organic materials that may act in the presence of moisture or high humidity as nutrients for such microbial growth. A satisfactory alternative facing material less susceptible to growth is highly sought.

A further drawback of paper-faced gypsum board is flame resistance. In a building fire, the exposed paper facing quickly burns away. Although the gypsum itself is not flammable, once the facing is gone the board's mechanical strength is greatly impaired. At some stage thereafter the board is highly likely to collapse, permitting fire to spread to the underlying framing members and adjacent areas of a building, with obvious and serious consequences. A board having a facing less susceptible to burning would at least survive longer in a fire and thus be highly desirable in protecting both people and property.

In an attempt to overcome these and other problems, a number of alternatives to paper facing have been proposed. U.S. Pat. No. 4,647,496 discloses an exterior insulation system including a fibrous mat-faced gypsum board having a set gypsum core that is water-resistant. The fibrous mat is preferably sufficiently porous for the water in the gypsum slurry to evaporate during the production drying operation as the gypsum sets. The mat comprises fibrous material that can be either mineral-type or a synthetic resin. One preferred mat comprises non-woven glass fibers, randomly oriented and secured together with a modified or plasticized urea formaldehyde resin binder, and sold as DURA-GLASS® 7502 by the Manville Building Materials Corporation.

However, gypsum board products incorporating such conventional fibrous mats have proven to have certain drawbacks. While fibrous mats are undesirably more costly than the traditionally used kraft paper, there are other, more troublesome issues as well. Some persons are found to be quite sensitive to the fiberglass mat, and develop skin irritations and abrasions when exposed to the mat at various stages, including the initial production of the mat, the manufacture of composite gypsum board with the mat facing, and during the cutting, handling, and fastening operations (e.g., with nails or screws) that attend installation of the end product during building construction. Handling of the mat, and especially cutting, is believed to release glass fibers responsible for the irritation. The fibers may either become airborne or be transferred by direct contact. As a result, workers are generally forced to wear long-sleeved shirts and long pants and to use protective equipment such as dust masks. Such measures are especially unpleasant in the sweaty, hot and humid conditions often encountered either in manufacturing facilities or on a construction jobsite.

Many of the known glass-fiber faced gypsum boards also suffer from their relatively rough surfaces. For some applications, such as external insulation systems, a smooth trowel coating of stucco or similar material must be applied to provide sufficient water resistance. A rough surface necessarily entails a coating that requires substantial amounts of material applied in a relatively thick layer to attain adequate coverage and a smooth surface.

Known glass fiber mat systems in many cases also lack strength and resistance to mat delamination. The formaldehyde-based binders often used are being intensively scrutinized as having possible health risks, particularly when used in interior products.

There have been suggestions that a small portion of the glass fiber in such mats be replaced by polymer fiber materials and that an acrylic binder be used instead of urea formaldehyde resin. While gypsum boards incorporating such mats have somewhat improved strength and handling characteristics, they are undesirably more expensive to make and stiffer and less fire resistant. Moreover, the problems of irritation from dust released, e.g. during cutting, remain.

Another form of mat-faced gypsum board is known from U.S. Pat. No. 4,879,173, which discloses a mat of non-woven fibers having a reinforcing resinous binder that can comprise a single resin or a mixture of resins, either thermoplastic or thermosetting. Exemplary resins disclosed include a styrene-acrylic copolymer and a self-crosslinking vinyl acetate-acrylic copolymer. A small amount of the binder is applied to the surface of the mat and penetrates but part of the way therethrough. The board is said to be useful as a support member in a built-up roof. The highly textured surface of the mat binder provides many interstices into which can flow an adhesive used to adhere an overlying component. However, considerable care is required in using a mat containing substantial numbers of voids as a facer for gypsum board. Conventional processing that incorporates deposition of a relatively wet slurry is generally found to result in considerable intrusion of the slurry through the mat and onto the faced surface, which is frequently undesirable. Prevention of this excess intrusion typically requires very careful control of the slurry viscosity, which, in turn, frequently leads to other production problems. Alternative mats, which inherently limit intrusion, yet still have sufficient permeability to permit water to escape during the formation and heat drying of the gypsum board, are thus eagerly sought as a simpler alternative.

A fibrous mat facer with improved bleedthrough resistance and useful as a facer substrate or carrier for receiving a curable substance in a fluid state is disclosed by U.S. Pat. No. 4,637,951. The porous, non-woven mat comprises a blend of microfibers intermixed and dispersed with base fibers and bound with a binder comprising a water miscible combination of a heat settable polymer. The mat is said to be useful in forming composite materials employing a curable thermoset, preferably foamable material such as a polyurethane or polyisocyanurate rigid foam board and as a carrier web in the vinyl flooring industry where the settable polymer comprises a vinyl plastisol. However, mat bound with a thermoset binder has been found to have relatively low delamination strength.

U.S. Pat. No. 5,883,024 to O'Haver-Smith et al. provides a fibrous mat-faced gypsum board said to exhibit improved resistance to skin irritation and itching. The result is achieved by incorporating a minor portion by weight, preferably from about 5 to 25% by weight, of organic fibers. The benefit of reduced skin irritation is not achieved with less than 5% organic fibers. The binders used are preferably acrylic or PVC-based. The '024 patent further discloses the use of a secondary reinforcing binder that also may be termed a secondary coating. This secondary binder preferably imparts resistant to water, heat, and alkalinity. In order to inhibit bleed-through of gypsum through the facer of the '024 construction board, control of the viscosity of the gypsum slurry is suggested, e.g. by incorporation of a viscosity control agent, such as paper fiber, cellulose thickeners, bentonite clays, and starches.

Still another mat-faced gypsum board is disclosed by U.S. Pat. No. 6,001,496 to O'Haver-Smith. The mat employs inorganic fibers having a diameter of less than about 15 μm and has a basis weight of greater than about 1.85 lb/100 $ft^2$. As a result of gypsum slurry bleed-through, mats formed from fibers having diameters predominantly of about 16 μm or greater are said not to fully satisfy the objects of the invention, even if the mats have a relatively high basis weight, e.g. a basis weight of 2.1 lb/100 $ft^2$ or greater. The '496 patent further discloses a gypsum board production process in which a gypsum slurry, sandwiched between two fibrous mats of the foregoing type, is passed through an extrusion wedge to exert a compressive force on the work product and thereby improve the uniformity of the thickness of the finished board.

Notwithstanding the advances in the field of gypsum boards and related articles, there remains a need for a readily and inexpensively produced mat-faced gypsum board having one or more of a smoother surface, a stronger internal bond to prevent delamination of the facer when subjected to prolonged wetness after installation, and better flame and mold resistance.

SUMMARY OF THE INVENTION

The present invention provides a construction board and a process for the manufacture thereof. In an implementation, the board comprises a layer of set gypsum or other cementitious material having a first face and a second face and an uncoated fibrous mat affixed to at least one of the faces. The mat includes a non-woven web of glass fibers bonded together with a resinous binder. The glass fibers consist essentially of a blend of a major portion of chopped glass fibers having an average fiber diameter of at least about 16 μm and a minor portion consisting essentially of at least one of small diameter glass fibers having a fiber diameter of at most about 13 μm and microfibers having an average fiber diameter ranging from about 0.05 to about 6.5 μm. The minor portion comprises about 5-30 percent of the dry weight of the web.

In another implementation, the board is faced with an uncoated fibrous mat in which the binder consists essentially of a styrene acrylic copolymer binder and the glass fiber consists essentially of a major portion of chopped glass fibers having an average fiber diameter ranging from about 8 to 25 μm and optionally a minor portion consisting essentially of at least one of small diameter glass fibers having a fiber diameter of at most about 13 μm and microfibers having an average fiber diameter ranging from about 0.05 to about 6.5 μm.

Further provided is an uncoated non-woven fibrous mat, comprising a non-woven web bonded together with a resinous binder consisting essentially of a styrene acrylic binder. The mat comprises glass fiber consisting essentially of a blend of a major portion of chopped glass fibers having an average fiber diameter ranging from about 8 to 25 μm and optionally a minor portion consisting essentially of at least one of small diameter glass fibers having a fiber diameter of at most about 13 μm and microfibers having an average fiber diameter ranging from about 0.05 to about 6.5 μm.

Still further is provided a process for manufacturing an article comprising a hydraulic set material layer having first and second faces, and first and second facers affixed thereto. The process comprises: (i) forming an aqueous slurry comprising at least one member selected from the group consisting of anhydrous calcium sulfate, calcium sulfate hemi-hydrate, and hydraulic setting cement; (ii) distributing the slurry to form a layer on the first facer; (iii) applying the second facer onto the top of the layer; (iv) separating the resultant laminate into individual articles; and (v) drying the articles. At least one of the facers is an uncoated fibrous mat comprising a non-woven web bonded together with a resinous binder consisting essentially of a styrene acrylic binder. The web comprises glass fiber consisting essentially of a major portion of chopped glass fibers having an average fiber diameter ranging from about 8 to 25 μm and optionally a minor portion consisting essentially of at least one of small diameter glass fibers having a fiber diameter of at most about 13 μm and microfibers having an average fiber diameter ranging from about 0.05 to about 6.5 μm.

The non-woven fibrous mat used in the present gypsum board is uncoated, by which is meant that beyond the primary binder used to bind the fiber constituents, no other secondary binder or other coating is applied that substantially affects its strength or other physical and mechanical properties. Nevertheless the mat attains resistance to bleedthrough without requiring such a secondary binder or coating, while maintaining a sufficiently large pore size and air permeability to be compatible with the water extraction needed in conventional gypsum board production. By a "secondary binder" or "secondary coating" is meant a binder or coating applied in a secondary step after a primary binder is applied to the non-woven mat giving its basic structure and integrity. Mat provided in accordance with the present invention does not require a secondary binder or coating, because the primary binder provides the required mechanical and functional properties, which may include, inter alia, high bond strength and water repellency.

The gypsum board of the invention typically is used for a number of purposes in building construction, such as a surface material for walls and ceilings and as an underlayment for floors, roofs, and the like. The board finds application in both interior and exterior environments.

As a result of the selection of fibers and binder in the facing, the board has a smooth, uniform surface that is readily finished. The mat structure inhibits bleedthrough of gypsum onto rolls or other structures used in gypsum board production, while maintaining an average pore size and an air permeability that facilitate the extraction of excess water present in the gypsum slurry from which the finished set gypsum layer is obtained. Various embodiments of the invention have further desirable attributes, including resistance to flame, moisture, and growth of mold and mildew. In addition, the inadvertent release of fibers from the mat used in the present gypsum board is minimized, limiting the incidence of skin irritation among workers involved in either production or installation of the board.

BRIEF DESCRIPTION OF THE DRAWING

The invention will be more fully understood and further advantages will become apparent when reference is had to the following detailed description of the preferred embodiments of the invention and the accompanying drawing, in which.

DETAILED DESCRIPTION OF THE INVENTION

Figure 1:
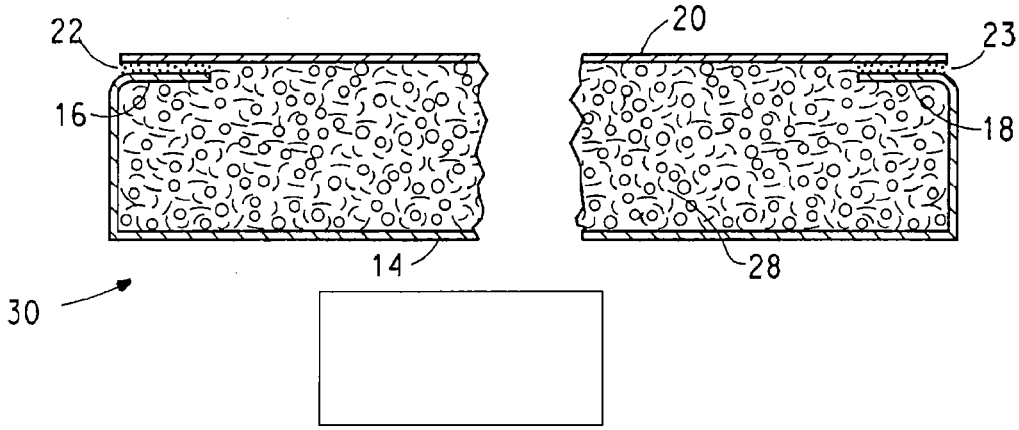
FIG. 1 is a cross-sectional view of a mat-faced gypsum board of the invention.

The present invention provides gypsum board and other hydraulic set and cementitious boards having front and back large surfaces, at least one of which is faced with a non-woven, fibrous mat. By hydraulic set is meant a material capable of hardening to form a cementitious compound in the presence of water. Typical hydraulic set materials include gypsum, Portland cement, pozzolanic materials, and the like.

Referring now to FIG. 1, there is shown generally at 30 a sectional view across the width direction of one embodiment of a mat-faced gypsum board in accordance with the invention. The board comprises a layer of set gypsum 28, which is sandwiched between first and second fibrous mats 14, 20, and bonded thereto. Two right-angled folds are formed in each lateral edge of first mat 14, a first upward fold and a second inward fold. The two folds are separated by a small distance, whereby the thickness of board is generally determined. The second folds define longitudinally extending strips 16 and 18 that are substantially parallel to the main part of the mat. A second fibrous mat 20 covers the other side of the set gypsum core 28. The respective lateral edges of second mat 20 are affixed to strips 16 and 18, preferably with adhesive 22, 23. Ordinarily board 30 is installed with the side bearing mat 14 facing a finished space. The board is advantageously ready for painting, but other finishing forms such as plaster, wallpaper or other known wall coverings may also be applied with a minimum of surface preparation.

The mats used in the present invention for one or both of the large faces of the gypsum board comprise a non-woven web bonded together with a resinous binder. In an embodiment, the web comprises glass fiber consisting essentially of a blend of a major portion of chopped glass fibers having an average diameter of at least about 16 μm and a minor portion consisting essentially of at least one of small diameter glass fibers having a fiber diameter of at most about 13 μm and microfibers having an average fiber diameter ranging from about 0.05 to about 6.5 μm. Microfibers are also known as fine staple fibers. The minor portion comprises about 5-30 percent, preferably about 15-30 percent, and more preferably about 20-30 percent, of the weight of the dry web.

Chopped strand fibers are readily distinguishable from microfibers by those skilled in the art. Microfibers are usually made by processes such as rotary fiberization or flame attenuation of molten glass known in the fiber industry. They typically have a wider range of lengths and fiber diameters than chopped strand fibers. Commonly the microfibers have a distribution of lengths ranging from a few times their diameters up to about 7 mm, with a few fibers as long as about 12 mm. For some embodiments it is preferred that the microfibers have a preferred diameter ranging from about 2.5 to 3.5 μm. Although more expensive, microfibers having a smaller diameter are also useful in the practice of the present invention. One method of making the fine fibers is disclosed by U.S. Pat. No. 4,167,404, which disclosure is hereby incorporated in the entirety by reference thereto.

The use of fibrous mats containing a combination of chopped, relatively large diameter fibers and additional smaller fibers and/or staple microfibers of lesser diameter in producing gypsum board and related products conveys a number of advantages over boards made with other known fibrous mats. The smaller fibers tend to fill the interstices between large fibers, thereby limiting the intrusion of gypsum slurry into and through the mat onto the board surface. Surprisingly, this control is achieved without unduly compromising the permeability of the mat for residual water vapor in the gypsum that must be removed during board production.

As a result of the foregoing measures, the need for careful control of slurry viscosity to limit bleedthrough during board production with the present mat is greatly eased, leading to cost reduction and manufacturing efficiency. Bleedthrough is undesirable, because it degrades the surface of the finished construction board and it frequently collects on rollers and other production tooling, leading to shutdowns of production lines for cleaning.

In some embodiments, suitable arrangement of the distribution of fiber size affords further and more precise control of the porosity and air permeability of the fibrous mat and the corresponding propensity for bleed-through of the gypsum slurry. The use of a suitable fiber distribution also imparts sufficient smoothness to permit a coating of stucco or like material to be trowel-applied for applications such as external insulation systems. The surface is rough enough to permit a stucco layer to adhere tenaciously, but smooth enough to permit a thin coating with relatively high area coverage.

Some board embodiments also employ mat that exhibits a high degree of hydrophobicity, i.e. a low propensity for absorption of water as either liquid or vapor. The degree of hydrophobicity is conveniently quantified by experiments in which the mat is exposed to liquid water and the amount absorbed is determined by weight. For example, testing may be carried out by supporting a mat sample either vertically or horizontally and supplying water for the sample to absorb. After a suitable exposure, the amount of water absorbed is measured by comparison of weights. Typical protocols for such tests are delineated by Association of the Nonwoven Fabrics Industry (INDA) Liquid Wicking Rate Standard Test 10.1 and American Society for the Testing of Materials (ASTM) Standard D5802.

Preferably, mat used for the present gypsum board has a low hydrophobicity, e.g. a water uptake of no more than about three times the basis weight of the mat. One means of attaining such hydrophobicity is the use of a styrene acrylic copolymer binder to form the mat. Surprisingly and unexpectedly, use of such a binder obviates the need for a secondary binder or coating or the mat or board heretofore thought needed to limit water absorption.

A preferred chopped glass fiber for the major portion of the fibrous web is at least one member selected from the group consisting of E, C, and T type and sodium borosilicate glasses. As is known in the glass art, E glass refers to a family of glasses typically with a calcium aluminoborosilicate composition and a maximum alkali content of 2.0% that are also known as electrical glasses. E glass fiber is commonly used to reinforce various articles. C glass typically has a soda-lime-borosilicate composition that provides it with enhanced chemical stability in corrosive environments, and T glass usually has a magnesium aluminosilicate composition and especially high tensile strength in filament form. The chopped fibers of the major portion can have varying lengths or substantially similar lengths. E-glass chopped fiber having an average fiber length ranging from about 6 to 19 mm is preferred. More preferably, the fiber length ranges from about 6 to 12 mm, and the average diameter ranges from about 16 to 18 μm The small diameter fibers used in the minor portion of the web fibers consist essentially of glass fibers having a fiber diameter of at most about 13 μm and may be provided from chopped strand fibers or other sources.

The microfiber or staple fibers used in the minor portion of the web are preferably glass or mineral fibers, such as mineral wool, slag wool, ceramic fibers, carbon fibers, metal fibers, refractory fibers, or mixtures thereof. Although it is preferred that the aforementioned fibrous mat comprising a blend of fibers be used for both facings of the board, one of the faces may also be formed with kraft paper, other glass mats, or other facings conventionally used in gypsum board. Glass microfibers that are biosoluble are also preferred. Such microfibers dissolve when exposed to a synthetic physiological fluid. It is believed that such fibers substantially reduce or eliminate dangers associated with inhalation by a human, since the fibers typically degrade over time at a rate sufficient to prevent serious harm. Examples of such biosoluble microfibers are provided by U.S. Pat. Nos. 6,656,861, 6,794,321, and 6,828,264, all to Bauer et al. These patents are all assigned to the assignee of the present invention and are all herein incorporated in their entirety by reference thereto.

The aforementioned glass fibers are bound together with any known resinous binder that imparts sufficient strength and water resistance to the mat. A preferred binder for the present mat comprises a styrene acrylate copolymer binder latex with a GTT of about 20° C. available from Lubrizol Advanced Materials of Cleveland, Ohio, under the tradename Hycar™ 26869. As delivered, this acrylate copolymer latex has a solids content of about 50 weight percent solids, but it is preferred to dilute the concentration with water to about 30 wt. percent solids before using it. Preferably up to about 10 weight percent of a crosslinker such as melamine formaldehyde is added to the acrylate; and more preferably about 2 to 5 weight percent of crosslinker is added. Expensive fluorochemical emulsions needed in prior art binders are not required.

The amount of binder (and any optional cross-linker) left in the wet mat during manufacture can be determined by a loss on ignition (LOI) test, the result thereof being specified as a percentage of the dry weight of the finished mat. Preferably, the amount of binder in the final mat, based on its dry weight, ranges from about 20 to 40 wt. percent, with about 25 to 30-wt. percent being more preferred, and 28±2.5 wt. percent being most preferred. The upper limit is dictated by process constraints and cost, while the minimum is required for adequate tensile strength.

Optionally the fibrous mats of the present invention further contain fillers, pigments, or other inert or active ingredients either throughout the mat or concentrated on a surface. For example, the mat can contain effective amounts of fine particles of limestone, glass, clay, coloring pigments, biocide, fungicide, intumescent material, or mixtures thereof. Such additives may be added for known structural, functional, or aesthetic qualities imparted thereby. These qualities include coloration, modification of the structure or texture of the surface, resistance to mold or fungus formation, and fire resistance. Preferably, flame retardants sufficient to provide flame resistance, e.g. according to NFPA Method 701 of the National Fire Protection Association or ASTM Standard E84, Class 1, are added. Biocide is preferably added to the mat and/or gypsum slurry to resist fungal growth, measurable in accordance with ASTM Standard D3273.

Gypsum board in accordance with the present invention preferably is faced with a mat having a basis weight ranging from about 1.8 to 3.0 pounds per 100 square feet, more preferably ranging from about 2.0 to 2.6 lbs./100 sq. ft (about 88-147 and 98-127 g/m$^2$, respectively). Preferably the binder content of the dried and cured mats ranges from about 20 to 40 wt. percent, more preferably from about 25 to 35 wt. percent, and most preferably from about 28±3 wt. percent, based on the weight of the finished mat. The basis weight must be large enough to provide the mat with sufficient tensile strength for producing quality gypsum board. At the same time, the binder content must be limited for the mat to remain sufficiently flexible to permit it to be bent to form the corners of the board, as shown in FIG. 1. Furthermore, too thick a mat renders the board difficult to cut during installation. Such cuts are needed both for overall size and to fit the board around protrusions such as plumbing and electrical hardware. Non-woven glass fiber mat used in the present construction board preferably exhibits high resistance to delamination. This property is conveniently assessed using a form of tensile testing, known in the art as Z-tensile testing, in which the opposing faces of a mat sample are adhered to platens on the opposite heads of a mechanical testing machine using a tenacious double-sided, pressure sensitive tape. The tensile force needed to delaminate the sample is known as the Z-tensile strength. Gypsum board faced with high Z-tensile strength mat exhibits favorable strength and durability, permitting it to withstand the stresses invariably encountered in manufacturing, handling, shipping, and installing the board, and during its subsequent service.

The utility of the present mat is further enhanced by its relatively high air permeability. During the gypsum board formation process, far more water is present in the gypsum slurry than is stochiometrically needed to drive the gypsum rehydration reaction. The excess is removed during a drying operation, and preferably escapes through the facings. Hence, facers must have sufficient permeability to allow the drying to be accomplished within an acceptable time period and without bubbling, delamination, or other degradation of the facer. The air permeability of a mat is conventionally determined by measuring the air flow driven by a pressure differential between reservoirs separated by the mat. One such test is called the Frazier test and further described by ASTM Standard Method D737, with the results ordinarily being given in units of cubic feet per minute per square foot (cfm/ft$^2$). The test may be carried out at a differential pressure of about 0.5 inches of water. In preferred embodiments, the permeability of the present mat, as measured by the Frazier method, is at least about 300 cfm/ft$^2$, more preferably, at least about 400 cfm/ft$^2$, and most preferably, at least about 500 cfm/ft$^2$.

Any suitable method may be used to form the present mats. One such method, known from U.S. Pat. No. 4,129,674, employs a wet-laid, inclined wire screen mat-forming machine. The '674 patent is incorporated herein in its entirety by reference thereto. Generally stated, the method comprises forming a slurry, preferably a water slurry, containing the requisite fibers. The solids content of such a slurry may be very low, such as approximately 0.2%. The slurry is intensely mechanically agitated to disperse the fibers uniformly therein and then dispensed onto a moving screen. A vacuum is applied to remove a substantial part of the water, which is preferably recycled, and thereby form a web of the fibers. After application of a binder, the web is heated to evaporate any remaining water and cure the binder, thus forming the bonded mat. Preferably, the mat-forming process is carried out in a continuous operation. The moving screen is provided as a continuous, conveyor-like loop and is slightly upwardly inclined during the portion of its travel in which the fiber slurry is deposited thereon. Subsequently, a binder is applied and the mat heated to effect final drying and curing. After the vacuum step is completed, the web is optionally transferred to one or more additional downstream conveyor systems for binder application and passage through a heated oven for the final drying and curing operation. Machines suitable for carrying out such a web-forming process are available commercially and include devices manufactured under the tradenames Hydroformer™ by Voith-Sulzer of Appleton, WS, and Deltaformer™ by Valmet/Sandy Hill of Glenns Falls, N.Y.

For example, those processes described in U.S. Pat. Nos. 4,647,496, 5,220,762, and 6,524,679, all herein incorporated by reference, may also be used, but the method of the present invention is not limited to only these known processes of making fibrous mat faced gypsum board.

The aqueous binder solution is preferably applied using a curtain coater or a dip and squeeze applicator. Normally, the mat is subjected to temperatures of about 120-260° C. for periods usually not exceeding 1 or 2 minutes, and frequently less than 40 seconds, for the drying and curing operations. Other known methods for mat laying may also be used.

The invention further provides a method for making gypsum board and other hydraulic set and cementitious board products for interior and/or exterior use, i.e. products appointed for installation on either interior or exterior surfaces of building structures. By exterior surface is meant any surface of a completed structure expected to be exposed to weather; by interior surface is meant a surface within the confines of an enclosed, completed structure and not intended to be exposed to weather. The above-described non-woven, fibrous mat is present on at least one of the large faces of the gypsum board.

The present improved gypsum board production method comprises the steps of: forming an aqueous slurry comprising at least one of anhydrous calcium sulfate, calcium sulfate hemi-hydrate, and hydraulic setting cement; distributing the slurry to form a layer on a first facing; applying a second facing onto the top of the layer; separating the resultant board into individual articles; and drying the articles. The process is characterized in that at least one of the facings comprises a non-woven, fibrous mat having a fibrous web comprising fibers, including a major portion of chopped continuous glass fibers and an optional minor amount of small-diameter glass fiber and/or microfiber. The fibers in the web are bound together with a polymeric binder. The second facer may be formed of a different material, such as kraft paper, but preferably is a non-woven, uncoated fibrous mat of the same type as the first facer.

The slurry optionally includes reinforcing fibers or other known additives used as process control agents or to impart desired functional properties to the board, including one or more of agents such as biocides, flame retardants, and water repellants. The product of the invention is ordinarily of a form known in the building trades as board, i.e. a product having a width and a length substantially greater than its thickness. Gypsum and other hydraulic set and cementitious board products are typically furnished commercially in nominal widths of at least 2 feet, and more commonly 4 feet. Lengths are generally at least 2 feet, but more commonly are 8-12 feet or more.

Gypsum and other hydraulic set boards made in accordance with the present invention exhibit a number of desirable qualities. The fibrous mat used results in a surface that is smoother and more amenable to painting or other surface finishing processes than prior art boards. The mat is also more flexible, facilitating the bending operations needed to fold the facer around the core during production, as illustrated for mat 14 in FIG. 1. Moreover, board incorporating the fibrous mat of the invention has a reduced tendency to generate irritating dust during cutting and handling than prior art boards faced with other facing materials.

The following examples are presented to provide a more complete understanding of the invention. The specific techniques, conditions, materials, proportions and reported data set forth to illustrate the principles and practice of the invention are exemplary and should not be construed as limiting the scope of the invention.

Example 1

Hydrophobicity of Non-Woven Glass Fiber Mat

Non-woven glass fiber mats are prepared using a wet laid mat machine in the manner disclosed in U.S. Pat. No. 4,129,674, which is hereby incorporated in the entirety by reference thereto. The mats all employ JM Chop Pak E-glass chopped fibers produced by Johns Manville Corporation, Denver, Colo., and having an average fiber diameter of about 13 μm and an average fiber length of about 13 to 19 mm. Samples are prepared using two binder systems, namely Lubrizol Hycar 26138, an acrylic copolymer, and Lubrizol Hycar 26868, a styrene acrylic copolymer, and are applied with a curtain coating/saturation technique. Both binders are commercially supplied by Lubrizol Advance Materials of Cleveland, Ohio and further contain small amounts of a conventional urea formaldehyde cross-linker and a water repellant. Non-formaldehyde based crosslinkers can also be used. The mats all have a basis weight of about 2.2 lb/100 square feet.

The hydrophobicity of the mats is tested using a horizontal wicking process. Each sample is placed on a flat on a horizontally disposed porous glass interface that has is connected to a source water reservoir and has been saturated with water. The mat allowed to absorb water through its bottom side from the porous glass surface. A mild compressive pressure of 0.1 psi is applied to the mat top side to enhance mat-water interface without compressing the structure of the composite. The sample is weighed before and after the water exposure to determine absorption. Results are set forth in Table I below.

TABLE I

Hydrophobicity of Non-Woven Glass Fiber Mats

| Sample No. | Binder | Dry Wt. (g) | Water Absorbed. (g) | Absorp. (g-$H_2O$/g-mat) |
|---|---|---|---|---|
| 1 | acrylic | 0.243 | 7.741 | 31.9 |
| 2 | acrylic | 0.23 | 8.157 | 35.5 |
| 3 | styrene acrylic | 0.227 | 0.595 | 2.6 |
| 4 | styrene acrylic | 0.226 | 0.54 | 2.4 |

The data of Table I demonstrate more than a ten-fold reduction in water absorption resulting from use of a styrene acrylic copolymer binder instead of a conventional non-styrenated acrylic binder, with the styrenated binder providing a mat that absorbs less than three times its weight in water.

Example 2

Tensile Testing of Non-Woven Glass Fiber Mats

Non-woven glass fiber mats are prepared to determine the effect of binder type on the tensile strength of the mats against delamination. Table II below sets forth certain mats and binder systems considered.

TABLE II

Non-Woven Glass Fiber Mats

| Sample No. | Composition | Binder |
|---|---|---|
| 10 | 88% 16 μm/25 mm + 12% polyester | 92% acrylic[1] + 5% UF[2] + 3% WR[3] |
| 11 | 100% 16 μm/25 mm | PVC copolymer |
| 12 | 100% 13 μm/19 mm | 98% MF[5] + silane + wetting agent |
| 13 | 50% 13 μm/19 mm + 50% 11 μm/12 mm | 100% acrylic[1] |
| 14 | 100% 16 μm/25 mm | 100% Hystretch V-29[8] |
| 15 | 100% 13 μm/19 mm | 98% MF + silane + wetting agent + 3% Sequapel |

Notes:
[1]acrylic = Hycar 26138 acrylic binder
[2]UF = urea formaldehyde
[3]WR = water repellant
4. Hystretch V-29 = low $T_g$__acrylic binder (Lubrizol Advanced Materials)

Table III gives corresponding Z-tensile test results for the samples of Table II, tested using samples having dimensions of approximately 1.5"×3". For each sample, a tenacious, double-sided pressure sensitive tape is used to adhere the opposed sides of the mat sample to platens on the respective heads of a mechanical testing machine. Values of peak load and the corresponding Z-tensile strength, measured per unit area, are provided.

TABLE III

Z-Tensile Behavior of Non-Woven Glass Fiber Mats

| Sample No. | Peak Load (lb) | Z-tensile (psi) |
|---|---|---|
| 10 | 42.3 | 9.40 |
| 11 | 47.9 | 10.84 |
| 12 | 23.7 | 5.27 |
| 13 | 35.2 | 7.82 |
| 14 | 31.9 | 7.09 |
| 15 | 18.7 | 4.16 |

It is seen that the melamine formaldehyde thermoset-bonded mats exhibit significantly lower Z-tensile strengths that are some 2-3 times or more lower than those of mats bonded with acrylic binders. PVC binder is seen to produce even stronger mats.

Example 3

Air Permeability and Pore Size Testing of Non-Woven Glass Fiber Mats

A series of non-woven glass fiber mats having various fiber blends is prepared, the mats having substantially equal basis weights of about 2.2 lb/100 $ft^2$ and approximate thicknesses as shown. The first three employ Hycar 26138 acrylic copolymer binder, and the fourth uses Hycar 26869 styrene acrylic copolymer binder. Both binders also include small amounts of urea formaldehyde cross-linker and water repellant.

The mats are tested for air permeability using a Fraser test at a differential pressure of about 0.5 inches of water in accordance with ASTM Method D737. Average pore size is determined using a capillary flow porometer technique.

TABLE IV

Air Permeability and Pore Size of Non-Woven Glass Fiber Mats

| Sample No. | Composition | Thickness (mil) | Air Perm. (cfm) | Avg. Pore Size (μm) |
|---|---|---|---|---|
| 21 | 80% 16 μm/12 mm + 20% 11 μm/6 mm | 39.1 | 574 | 138 |
| 22 | 50% 16 μm/12 mm + 50% 11 μm/6 mm | 37.9 | 513 | 110 |
| 23 | 85% 16 μm/12 mm + 15% microfiber | 32.7 | 394 | 86 |
| 24 | 85% 16 μm/12 mm + 15% microfiber | 31.7 | 410 | 90 |

The use of microfiber is particularly advantageous in permitting the air permeability and pore size to be controlled to desired values, typically a permeability of at least about 300 cfm/ft$^2$ and an average pore size of at least about 80 μm. These values are advantageously attained in combination with a dense, relatively closed, uniform, and smooth facer. Such air permeability and pore size values permit adequate extraction of water during a board curing process while providing a desirable level of protection for the mechanical properties of the gypsum core, and without permitting excessive gypsum bleed-through. The relatively low porosity of the mat is further advantageous for some forms of finished gypsum board. For example, boards used for external insulation systems typically are protected by application of a trowel coating of stucco or the like. By carefully controlling the porosity and smoothness of the mat, a lesser coating thickness is required to attain full coverage than with mats not containing a fiber mixture including small fibers, and especially, microfibers. By way of contrast, previous processes involving coated mat typically reduce permeability to much lower values to inhibit bleedthrough, while adversely affecting the permeability needed to extract water.

Example 4

Non-Woven Glass Fiber Mats

A series of non-woven glass fiber mats having various fiber blends is prepared, the mats having varying basis weights as shown in Table V. The first three employ conventional microfiber, the fourth uses small diameter chopped staple fiber, and the fifth uses a biosoluble glass microfiber. All use Hycar 26869 styrene acrylic copolymer binder including small amounts of urea formaldehyde cross-linker and water repellant. The air permeability and average pore size set forth in Table V render these mats suitable for use in gypsum and like construction boards permit adequate extraction of water during a board curing process while providing a desirable level of protection for the mechanical properties of the gypsum core, and without permitting excessive gypsum bleed-through.

TABLE V

Air Permeability and Pore Size of Non-Woven Glass Fiber Mats

| Sample No. | Composition | Basis Wt. (lb./100 ft$^2$) | Air Perm. (cfm) | Avg. Pore Size (μm) |
|---|---|---|---|---|
| 31 | 85% 16 μm/12 mm + 15% microfiber | 2.2 | 329 | 69 |
| 32 | 68% ½" M117, 17% 1" M 117 + 20% microfiber | 2.2 | 450 | 80 |
| 33 | 80% 13 μm/19 mm + 20% microfiber | 1.7 | 554 | 111 |
| 34 | 80% 16 μm/12 mm + 20% 11 μm/6 mm | 2.6 | 513 | 107 |
| 35 | 85% 16 μm/12 mm + 15% JM481* | 2.2 | 424 | 87 |

*JM 481 is a bio-soluble, hydro-pulpable glass microfiber made in accordance with the teachings of U.S. Patents 6,656,861, 6,794,321, and 6,828,264 and commercially available from Johns Manville, Denver, CO.

Fiberglass facers such as those of Table IV are particularly suited for use in gypsum boards appointed for exterior installation, including substrates for exterior insulation finishing systems. As a result of their delamination resistance, they provide advantageous protection of the gypsum core and contribute to the board's flexural strength. They facilitate production by minimizing bleedthrough of gypsum, while maintaining air permeability that is adequate to permit ready extraction of water that is driven off from the gypsum slurry during core curing.

Mat implementations providing good hydrophobic characteristic, such as those prepared with a styrene acrylic binder, also aid in achieving the recommended coating rate of the exterior insulation finish system (EFIS) materials. The EFIS materials include coatings and adhesives that are applied with a trowel to provide the exterior walls with a finished surface. The hydrophobicity of the glass facer further contributes to reduce gypsum bleedthrough during panel manufacture. The fiber blends produce a dense, closed, uniform, and smooth sheet which helps to minimize gypsum bleed through, provides protection to the gypsum core, and reduces trowel drag during the application of EIFS materials. The fiberglass mats are produced with lower air permeability and smaller pore size than conventional mats used in the gypsum facer applications. Such mats advantageously permit adequate extraction of water during a board curing process while providing a desirable level of protection for the mechanical properties of the gypsum core, and without permitting excessive gypsum bleed-through.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A gypsum board, comprising:

a. a gypsum layer having a first face and a second face and comprising set gypsum;

b. first and second facers affixed to said first and second faces, said first facer being an uncoated fibrous mat comprising a non-woven web bonded together with a resinous binder that includes a cross-linker in an amount ranging up to about 10 weight percent, and said web comprising glass fiber consisting essentially of a blend of a major portion of chopped glass fibers, said major portion consisting essentially of about 65-75% by weight of glass fiber having an average fiber diameter of about 16 μm and an average fiber length of about ½ inch and about 15-20% by weight of glass fiber having an average diameter of about 16 μm and an average fiber length of about 1 inch, and a minor portion consisting essentially of about 15-25% by weight of microfibers, substantially all of which have a fiber diameter in the range from about 2.7 to 3.4 μm, and wherein said first facer has a hydrophobicity such that it absorbs no more than three times its weight in water when tested in accordance with INDA Standard Test 10.1.

2. A gypsum board as recited by claim 1, wherein said chopped glass fibers are composed of at least one member selected from the group consisting of E glass, C glass, T glass, sodium borosilicate glass, and mixtures thereof.

3. A gypsum board as recited by claim 1, wherein said chopped glass fibers are composed of E glass.

4. A gypsum board as recited by claim 1, wherein said microfibers consist essentially of at least one member selected from the group consisting of fibers of glass, mineral wool, slag wool, ceramic, carbon, metal, refractory materials, and mixtures thereof.

5. A gypsum board as recited by claim 4, wherein said microfibers consist essentially of a bio-soluble glass.

6. A gypsum board as recited by claim 4, wherein said microfibers have a fiber length of less than about 7 mm.

7. A gypsum board as recited by claim 1, wherein said second facer is a fibrous mat comprising a non-woven web bonded together with a resinous binder, and said web comprising glass fiber consisting essentially of a blend of a major portion of chopped glass fibers having an average fiber diameter of at least about 16 μm and a minor portion consisting essentially of at least one of small diameter glass fibers having a fiber diameter of at most about 13 μm and microfibers having an average fiber diameter ranging from about 0.05 to about 6.5 μm, said minor portion comprising about 5-30 percent of the dry weight of the web.

8. A gypsum board as recited by claim 1, wherein said resinous binder comprises a styrene acrylic binder.

9. A gypsum board as recited by claim 1, wherein said cross linker is present in an amount ranging from about 2 to 5 weight percent.

10. A gypsum board as recited by claim 1, wherein said resinous binder has a glass transition temperature ranging from about 15 to 45° C.

11. A gypsum board as recited by claim 1, wherein said gypsum core comprises at least 85% by weight of set gypsum.

12. A gypsum board as recited by claim 1, wherein said gypsum core further comprises at least one water repellant agent.

13. A gypsum board as recited by claim 1, wherein said gypsum core further comprises a biocide.

14. A gypsum board as recited by claim 1, wherein said gypsum core further comprises reinforcing fiber.

15. A gypsum board as recited by claim 1, said board having flame resistance sufficient to pass the test of ASTM Method E84, Class 1.

16. A gypsum board, comprising:

a. a gypsum layer having a first face and a second face and comprising set gypsum;

b. first and second facers affixed to said first and second faces, said first facer being an uncoated fibrous mat comprising a non-woven web bonded together with a resinous binder that includes a cross-linker in an amount ranging up to about 10 weight percent, and said web comprising glass fiber consisting essentially of a blend of a major portion consisting essentially of about 80% by weight of chopped glass fiber having an average diameter of about 16 μm and an average fiber length of about 0.5 inch and a minor portion consisting essentially of about 20% by weight of small glass fiber having an average diameter of about 11 μm and an average fiber length of about 0.25 inch, and wherein said first facer has a hydrophobicity such that said first facer absorbs no more than three times its weight in water when tested in accordance with INDA Standard Test 10.1.

17. A gypsum board as recited by claim 1, wherein said major portion consists essentially of about 68% by weight of chopped glass fiber having an average diameter of about 16 μm and an average fiber length of about 0.5 inch and about 17% by weight of chopped glass fiber having an average diameter of about 16 μm and an average fiber length of about 1 inch and said minor portion consists essentially of about 20% by weight of microfibers, substantially all of which have a diameter in the range from about 2.7 to 3.4 μm.

18. An uncoated fibrous mat, comprising a non-woven web bonded together with a resinous binder comprising a styrene acrylic binder, and said web comprising glass fiber consisting essentially of a blend of a major portion of chopped glass fibers, said major portion consisting essentially of about 65-75% by weight of glass fiber having an average fiber diameter of about 16 μm and an average fiber length of about ½ inch and about 15-20% by weight of glass fiber having an average diameter of about 16 μm and an average fiber length of about 1 inch, and a minor portion consisting essentially of about 15-25% by weight of microfibers, substantially all of which have a fiber diameter in the range from about 2.7 to 3.4 μm, and wherein said fibrous mat has a hydrophobicity such that it absorbs no more than three times its weight in water when tested in accordance with INDA Standard Test 10.1.

19. A fibrous mat as recited by claim 18, said mat having a permeability of at least about 300 cfm/ft$^2$ measured in accordance with ASTM Standard D737 at a differential pressure of 0.5 inches of water.

20. A fibrous mat as recited by claim 18, said mat having an average pore size ranging from about 80 to 150 μm.

21. A fibrous mat as recited by claim 18, wherein said resinous binder further comprises a cross-linker in an amount ranging up to about 10 weight percent.

22. An uncoated fibrous mat, comprising a non-woven web bonded together with a resinous binder, and said web comprising glass fiber consisting essentially of a blend of a major portion of chopped glass fibers, consisting essentially of about 80% by weight of chopped glass fiber having an average diameter of about 16 μm and an average fiber length of about 0.5 inch and a minor portion consisting essentially of about 20% by weight of small glass fiber having an average diameter of about 11 μm and an average fiber length of about 0.25 inch, and wherein said fibrous mat has a hydrophobicity such that it absorbs no more than three times its weight in water when tested in accordance with INDA Standard Test 10.1.

23. A fibrous mat as recited by claim 22, said mat having a permeability of at least about 300 cfm/ft$^2$ measured in accordance with ASTM Standard D737 at a differential pressure of 0.5 inches of water.

24. A fibrous mat as recited by claim 23, said mat having an average pore size ranging from about 80 to 150 μm.

25. A fibrous mat as recited by claim 23, wherein said resinous binder further comprises a cross-linker in an amount ranging up to about 10 weight percent.

26. A gypsum board as recited by claim 16, wherein said chopped glass fibers are composed of at least one member selected from the group consisting of E glass, C glass, T glass, sodium borosilicate glass, and mixtures thereof.

27. A gypsum board as recited by claim 16, wherein said chopped glass fibers are composed of E glass.

28. A gypsum board as recited by claim 16, wherein said microfibers consist essentially of at least one member selected from the group consisting of fibers of glass, mineral wool, slag wool, ceramic, carbon, metal, refractory materials, and mixtures thereof.

29. A gypsum board as recited by claim 28, wherein said microfibers consist essentially of a bio-soluble glass.

30. A gypsum board as recited by claim 28, wherein said microfibers have a fiber length of less than about 7 mm.

31. A gypsum board as recited by claim 16, wherein said second facer is a fibrous mat comprising a non-woven web bonded together with a resinous binder, and said web comprising glass fiber consisting essentially of a blend of a major portion of chopped glass fibers having an average fiber diameter of at least about 16 μm and a minor portion consisting essentially of at least one of small diameter glass fibers having a fiber diameter of at most about 13 μm and microfibers having an average fiber diameter ranging from about 0.05 to about 6.5 μm, said minor portion comprising about 5-30 percent of the dry weight of the web.

32. A gypsum board as recited by claim 16, wherein said cross linker is present in an amount ranging from about 2 to 5 weight percent.

33. A gypsum board as recited by claim 16, wherein said resinous binder has a glass transition temperature ranging from about 15 to 45° C.

34. A gypsum board as recited by claim 16, said board having flame resistance sufficient to pass the test of ASTM Method E84, Class 1.

35. A gypsum board as recited by claim 1, wherein said resinous binder comprises a styrene acrylic binder.

36. An uncoated fibrous mat as recited by claim 22, wherein said resinous binder comprises a styrene acrylic binder.

* * * * *